US006276001B1

(12) United States Patent
Chen

(10) Patent No.: US 6,276,001 B1
(45) Date of Patent: Aug. 21, 2001

(54) PORTABLE SAUNA ENCLOSURE

(76) Inventor: Shu-Lien Chen, P.O. Box 55-175, Taichung (TW)

( * ) Notice: Subject to any disclaimer, the term of this patent is extended or adjusted under 35 U.S.C. 154(b) by 0 days.

(21) Appl. No.: 09/609,120

(22) Filed: Jun. 30, 2000

(51) Int. Cl.[7] ..... A61H 33/06
(52) U.S. Cl. ..... 4/527
(58) Field of Search ..... 4/526–532

(56) References Cited

U.S. PATENT DOCUMENTS 6,055,684 * 5/2000 Azuma ..... 4/526
6,170,097 * 1/2001 Lin ..... 4/526 X

* cited by examiner

*Primary Examiner*—Charles E. Phillips

(57) ABSTRACT

A portable sauna enclosure comprises a foldable frame, a canopy, and a control device. The frame includes a plurality of pivotably connected boards. The canopy is covered on the frame and stretched by it for forming a space. The canopy includes a band along the internal edge of a neck hole having a hook or loop fastener on either end of the band for securing the ends together for preventing dry air from leaking when the band encloses the neck of the person who takes a bath, two side straps on the back of canopy each having a hook or loop fastener for securing the canopy when folded. A control device is provided on a side of the canopy. A heating element for generating dry heated air is provided on the inner surface of frame. A heat resistant layer is sandwiched between the heating element and frame. A protective layer is formed on the heating element for preventing a person from injuring due to direct contact with the high temperature-heating element.

15 Claims, 4 Drawing Sheets

PORTABLE SAUNA ENCLOSURE

FIELD OF THE INVENTION

The present invention relates to a sauna and more particularly to a portable sauna enclosure having improved characteristics.

BACKGROUND OF THE INVENTION

Steam bath have been popular worldwide recently for health reasons. The only drawback of a steam bath is the high service charge due to the expensive associated facilities. As such, a relatively cheap portable sauna enclosure has been commercially available as shown in FIG. 1. The sauna enclosure comprises a frame 1 including a plurality of interconnected vertical and horizontal bars, a canopy 2 covered on the frame 1 and stretched by it for forming a space to allow a person to take a bath therein, canopy 2 having three holes 201 for the neck and two arms extending through and a zipper 202 for permitting a person to enter the sauna enclosure when it is unfastened, a steamer 3 outside the sauna enclosure, and a steam pipe 4 connected between the steamer 3 and the inside of the sauna enclosure for transferring steam from steamer 3 to the sauna enclosure. The user should add water into steamer 3 for heating. After bathing, the user should use a dry cloth to absorb the condensed steam (i.e., water) in the sauna enclosure in order to forestall the growth of micro-organisms on the canopy 2.

However, the previous design suffered from several disadvantages. For example, it is still possible for steam to pass through holes 201 and zipper 202 during bathing due to the gaps between human body (i.e., neck and arms) and holes 201 as well as the gaps in the zipper 202 itself. As such, the leaked steam may be subsequently carried from the bathroom to the other rooms in the house, resulting in a potential damage to the household appliances, furniture, and wall due to humidity. In addition, the assembly and disassembly of frame 1 and steam pipe 4 is a tedious job. Also, the efficiency of steamer 3 may be adversely affected if the packing between steam pipe 4 and steamer 3 is not well sealed. Furthermore, the bulky steamer 4 is not easy to store when not in use. In view of this, its portability is adversely affected. Thus, it is desirable to provide an improved portable sauna enclosure in order to overcome the above drawbacks of the prior art.

SUMMARY OF THE INVENTION

It is an object of the present invention to provide a portable sauna enclosure wherein the person enclosed therein may be exposed to dry heated air so as to induce sweating.

It is another object of the present invention to provide a portable sauna enclosure wherein the person enclosed therein may also be exposed to infrared emitted from a heated infrared layer in the enclosure for helping the metabolism of human body.

To achieve the above and other objects, the present invention provides a portable sauna enclosure comprising a foldable frame, a canopy, and a control device. Frame includes a plurality of pivotably connected boards. The canopy is covered on the frame and stretched by it for forming a space. The canopy includes a band along the internal edge of the neck hole having a Velcro© fastener on either end for securing together for preventing dry air from leaking when the band encloses the neck of the person who takes a bath, two side straps on the back of canopy each having a Velcro© fastener on the open end for securing together in folding the canopy, and a handle. A control device is provided on a side of canopy. A heating element for generating dry heated air is provided on the inner surface of the frame. A heat resistant layer is sandwiched between the heating the element and the frame. A protective layer is formed on the heating element for preventing a person from injury due to direct contact with the high temperature heating element.

The above and other objects, features and advantages of the present invention will become apparent from the following detailed description taken with the accompanying drawings.

DETAILED DESCRIPTION OF THE PREFERRED EMBODIMENTS

Figure 1:
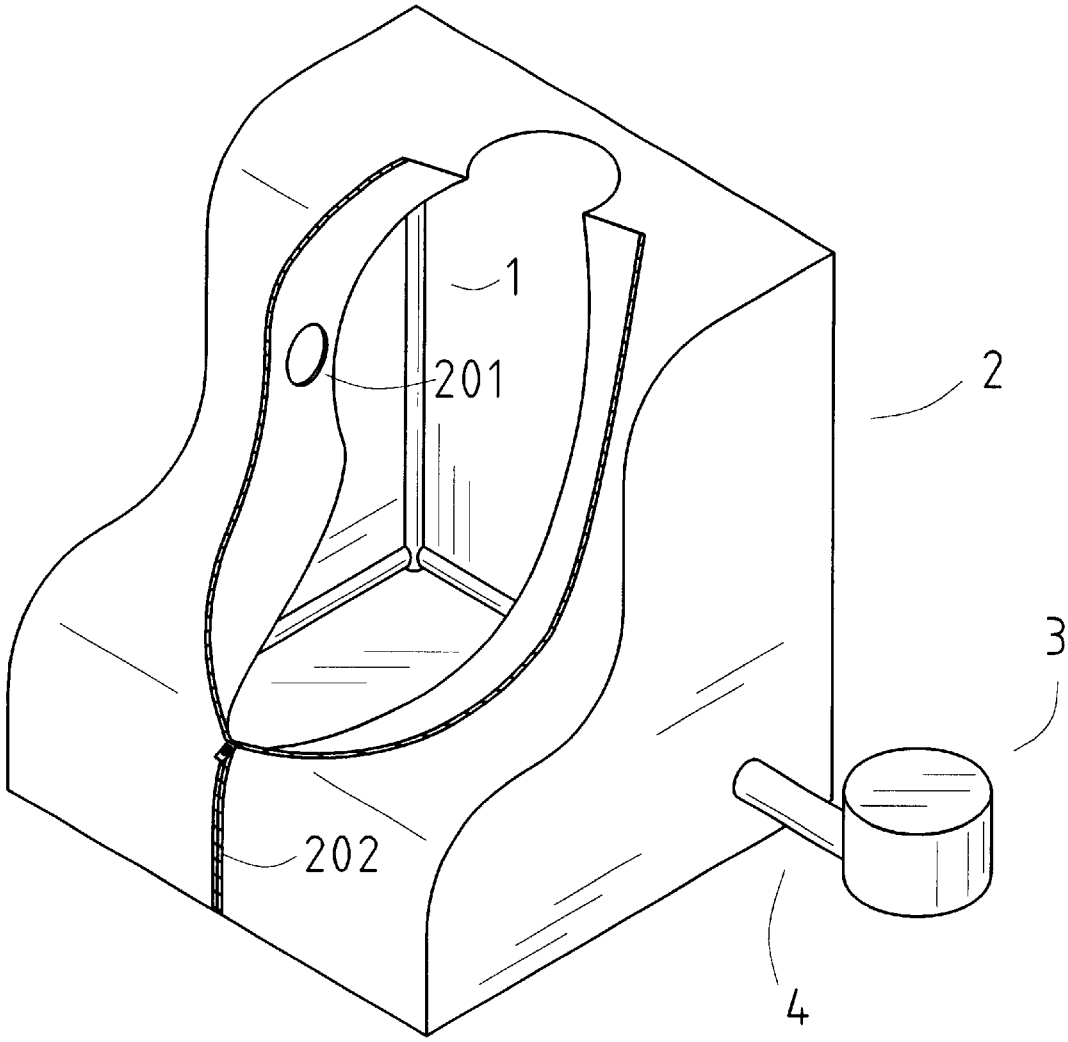
PRIOR ART FIG. 1
FIG. 1 is a perspective view of a conventional portable sauna enclosure, where a zipper opens to reveal the interior features thereof.
Figure 2:
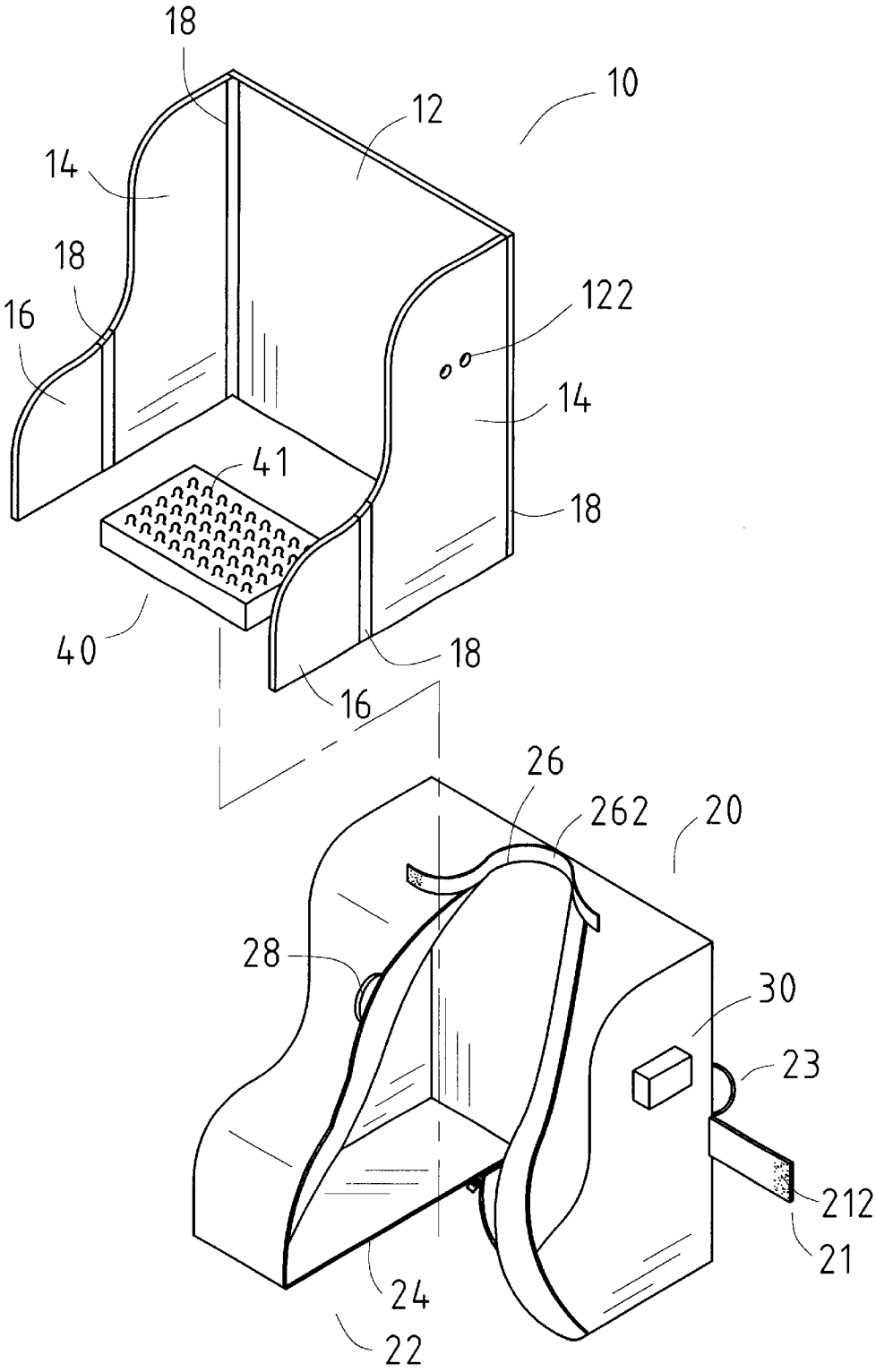
FIG. 2 is an exploded view of a first preferred embodiment of portable sauna enclosure according to the invention.

Referring to FIG. 2, there is shown a portable sauna enclosure constructed in accordance with the invention comprising a foldable frame 10, a canopy 20, and a control device 30.

Frame 10 includes a plurality of pivotably connected polypropylene (PP) boards such as back board 12, two rear side boards 14, two front side boards 16, and two resilient members 18 each connected between rear side board 14 and front side board 16. Two through holes 122 are provided on one of the rear side boards 14.

Canopy 20 covers the frame 10 and is stretched by it for forming a space to allow a person to take a bath therein. Canopy 2 has an entrance 22, a zipper 24 for sealing the entrance 22, a neck hole 26 and two arm holes 28 for permitting the neck and two arms extending there through, a band 262 along the internal edge of neck hole 26 having a Velcro© fastener on either end for securing together for preventing dry air from leaking when band 262 encloses the neck of the person who takes a bath, two side straps 21 on the back of canopy 20 each having a Velcro© fastener 212 on the open end for securing together in folding the canopy 2, and a carrying handle 23 on the back of canopy 20 between two side straps 21. The provision of handle 23 increases the portability of the invention.

Figure 3:
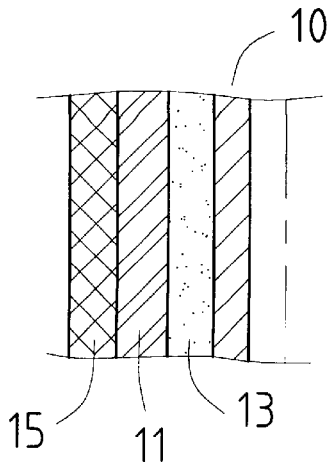
FIG. 3 is a cross-sectional view of the frame board of FIG. 2.

Referring to FIGS. 2 and 3, there is shown a heating element 11 (FIG. 3) provided on the inner surface of frame 10. Control device 30 is provided on a side of canopy 20. The electronic control device 30 comprises a temperature setting circuit and a protective circuit. A cord (not shown) is connected between control device 30 and heating element 11 through canopy 20 and holes 122. As such, control device 30 can supply power to heating element 11 for heating. The temperature setting circuit of control device 30 can control the temperature of heating element 11 Preferably, the operating temperature of heating element 11 is in the range of about 60° C. to 80° C. Also, the protective circuit of control device 30 may prevent a child or any other unauthorized persons from setting the above predetermined temperature.

Referring to FIG. 3 specifically, a heat resistant layer 13 is sandwiched between heating element 11 and frame board 10. Preferably, the heat resistant layer 13 is formed of heat proof material. More preferably, the heat resistant layer 11 is formed of fiberboard for preventing frame board 10 from degrading due to high temperature. A thick porous protective layer 15 made of cloth is formed on the inner surface of heating element 11 for preventing a person from injury due to direct contact with the high temperature heating element 11.

Referring to FIG. 2 specifically, there is shown a bath mat 41 provided on the ground surrounded by frame board 10. Bath mat 41 is heated by control device 30 through a power cord (not shown). Bathmat 41 comprises a plurality of raised members 41 on the surface. A heat exposure and massage effect are carried out to the feet when the feet step on the raised members 41.

In use, a user may sit on a chair with the head and the arms extended beyond the canopy 20. Then the body is exposed to dry air as to induce sweating. The benefits of dry heating is that no steam is generated during bathing. As such, there is no potential damage to the household appliances and furniture. Further, it may forestall the growth of micro-organisms on the frame 10 and canopy 20. Furthermore, it is not necessary for user to add water into the control device 30. This facilitates the cleaning after use.

Figure 4:
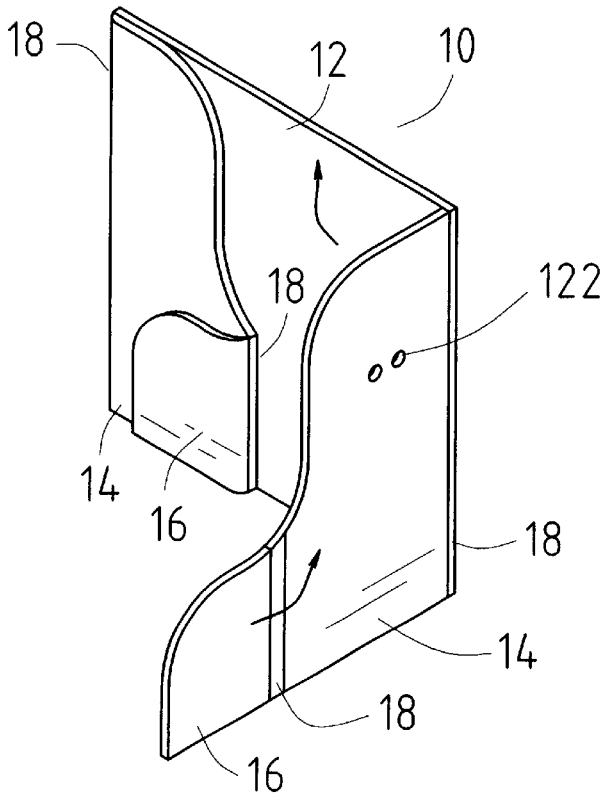
FIG. 4 is a perspective view of the unfolded frame of FIG. 2.

Referring to FIG. 4, the disassembly of frame 10 and canopy 20 is illustrated. In detaching, first fold the front side boards 16 to the external sides of the rear side boards 14 with the resilient members 18 serving as pivots. Then fold the rear side board 14 and front side board 16 on one side of back board 14 toward back board 12 as well as fold the rear side board 14 and front side board 16 on the other side of back board 14 toward back board 12. Then use side straps 21 to wrap the front portion of canopy 20 with Velcro© fasteners 212 secured to each other. This can effectively reduce the storage space. Also, the provision of handle 23 increases the portability of the enclosure of the invention.

Figure 5:
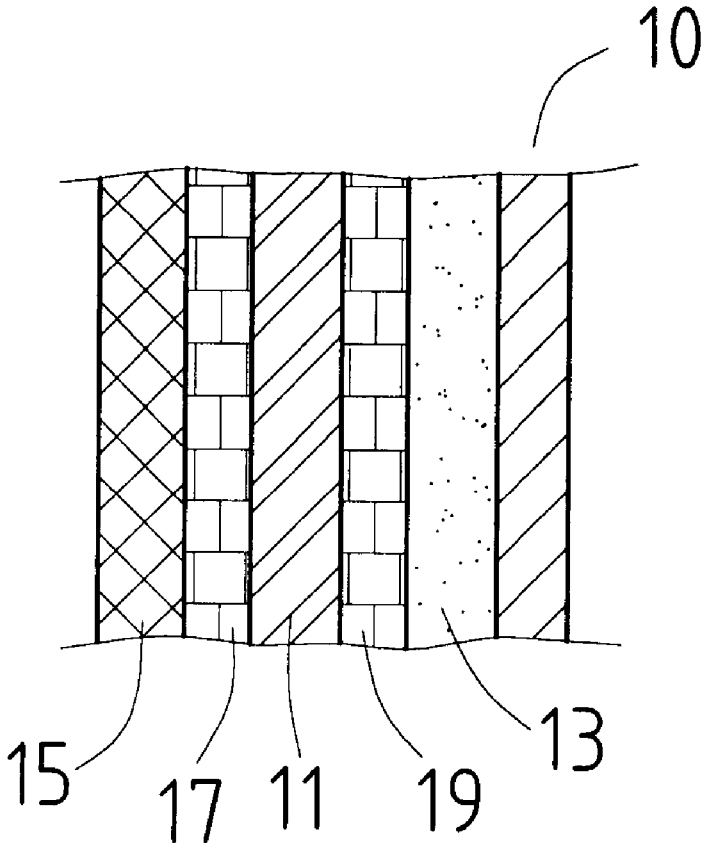
FIG. 5 is a cross-sectional view of the frame board of a second preferred embodiment of portable sauna enclosure according to the invention.

FIG. 5 illustrates a frame board of a second preferred embodiment of portable sauna enclosure according to the invention. The differences of the first and second preferred embodiments are as follows. A layer made of infrared material is formed between heating element 11 and protective layer 15. The heated infrared layer can emit infrared for helping the metabolism of human body. Further, the heat resistant layer 13 may be formed of a foam material. Furthermore, a metal film layer 19 is formed between the heat resistant layer 13 and heating element 11 for preventing the heat resistant layer 13 from degrading due to the direct contact with heating element 11.

While the invention herein disclosed has been described by means of specific embodiments, numerous modifications and variations could be made thereto by those skilled in the art without departing from the scope and spirit of the invention set forth in the claims.

What is claimed is:

1. A portable sauna enclosure for providing dry heated air to a user so as to induce sweating, the sauna enclosure comprising:

a foldable frame including a back board, two rear side boards, two front side boards, and two resilient members, one connected between each rear side board and the front side board;

a canopy covering the frame and stretched by it for forming a space therein, the canopy including an entrance, a zipper for sealing the entrance, a neck hole and two arm holes;

an electronic control device on the side of the canopy;

a heating element on the inner surface of the frame powered by the control device;

a heat resistant layer sandwiched between the heating element and the frame; and a protective layer on an inner surface of the heating element.

2. The portable sauna enclosure of claim 1, further comprising two side straps each having one end extended from the back of the canopy and the other free end for enclosing the canopy when folded.

3. The portable sauna enclosure of claim 2, wherein each of the side straps has a hook or loop fastener on the free end for securing said ends to each other.

4. The portable sauna enclosure of claim 1, further comprising a handle on the back of the canopy.

5. The portable sauna enclosure of claim 1, further comprising a band along the internal edge of the neck hole having a hook or loop fastener on either end for securing said ends for preventing dry air from leaking when the band encloses the neck of the user.

6. The portable sauna enclosure of claim 1, wherein the heat resistant layer is formed of a heatproof material.

7. The portable sauna enclosure of claim 1, wherein the heat resistant layer is formed of fiberboard.

8. The portable sauna enclosure of claim 1, further comprising a metal film layer between the heat resistant layer and the heating element for preventing the heat resistant layer from degrading, and wherein the heat resistant layer is formed of foam.

9. The portable sauna enclosure of claim 1, further comprising an infrared layer between the heating element and the protective layer, whereby infrared radiation is emitted from the heated infrared layer for helping the metabolism of the user.

10. The portable sauna enclosure of claim 1, wherein the protective layer is made of thick porous cloth.

11. The portable sauna enclosure of claim 1, further comprising a bath mat on the ground surrounded by the frame being heated by the control device for carrying out a heat exposure to the feet of the user.

12. The portable sauna enclosure of claim 11, wherein the bathmat comprises a plurality of raised members on the surface for providing a massage to the feet of the user.

13. The portable sauna enclosure of claim 1, wherein the control device comprises a temperature setting circuit for setting the temperature of the heating element.

14. The portable sauna enclosure of claim 13, wherein the control device further comprises a protective circuit for avoiding unauthorized setting of the temperature by the temperature setting circuit.

15. The portable sauna enclosure of claim 1, further comprising a plurality of through holes on one of the rear side boards for permitting the connection between the control device and the heating element.

* * * * *